US008584977B2

(12) United States Patent
Park et al.

(10) Patent No.: US 8,584,977 B2
(45) Date of Patent: Nov. 19, 2013

(54) FOOD WASTE DISPOSAL APPARATUS WITH CENTRIFUGAL DEHYDRATOR

(76) Inventors: No Hyeong Park, Gwangiu-si (KR); Dong Hue Kim, Goyang-si (KR); Byeon Sam Kim, Bucheon-si (KR)

( * ) Notice: Subject to any disclaimer, the term of this patent is extended or adjusted under 35 U.S.C. 154(b) by 17 days.

(21) Appl. No.: 13/381,975

(22) PCT Filed: Jun. 18, 2010

(86) PCT No.: PCT/KR2010/003961

§ 371 (c)(1),
(2), (4) Date: Jan. 2, 2012

(87) PCT Pub. No.: WO2011/002167

PCT Pub. Date: Jan. 6, 2011

(65) Prior Publication Data

US 2012/0104129 A1 May 3, 2012

(30) Foreign Application Priority Data

Jul. 3, 2009 (KR) ..... 10-2009-0060735
May 12, 2010 (KR) ..... 10-2010-0044395

(51) Int. Cl.
*B02C 23/36* (2006.01)

(52) U.S. Cl.
USPC ..... 241/46.013; 241/46.017; 241/46.08

(58) Field of Classification Search
USPC ..... 241/46.013, 46.014, 46.017, 46.08, 241/275; 210/173
See application file for complete search history.

(56) References Cited

U.S. PATENT DOCUMENTS

| | | | | |
|---|---|---|---|---|
| 4,337,901 | A * | 7/1982 | Ogura | 241/46.013 |
| 5,176,825 | A * | 1/1993 | Hadjis et al. | 210/259 |
| 8,002,979 | B2 * | 8/2011 | Bryan-Brown | 210/173 |
| 2004/0251359 | A1 | 12/2004 | Ozawa | |
| 2006/0169811 | A1 | 8/2006 | Kim | |

FOREIGN PATENT DOCUMENTS

| | | | |
|---|---|---|---|
| JP | 53025076 | A * | 3/1978 |
| JP | 53025077 | A * | 3/1978 |
| JP | 2007-275862 | A | 10/2007 |
| KR | 10-2010-0040061 | * | 4/2010 |
| WO | 2008-150059 | A1 | 12/2008 |

OTHER PUBLICATIONS

International Search Report for PCT Application No. PCT/KR2010/003961, Korean Intellectual Property Office, Jan. 28, 2011.

* cited by examiner

*Primary Examiner* — Dana Ross
*Assistant Examiner* — Leonel Vasquez

(57) ABSTRACT

A food waste processing apparatus is disclosed. In the food waste processing apparatus according to the embodiment of the present invention, after food waste is dehydrated by a centrifugal force within the upper drum part and the lower drum part which are rotated to be discharged, it is discharged to the outside of the housing by the rotation of the lower drum part. That is, since food waste is dehydrated, discharged, and drained by one part, manufacturing costs can be reduced. Further, since food waste is broken up, dehydrated, discharged, and drained by one motor, manufacturing costs can be reduced further. Furthermore, since the lower drum part is vertically moved by a relatively simple structure of a cam, a structure of the rotary shaft, and an inertial force, manufacturing costs can be reduced still further. Food waste is dehydrated and discharged by a centrifugal force and the food waste within the housing is discharged to the outside of the housing by the discharge blade installed in the drum. That is, since food waste can be completely dehydrated, discharged, and drained, the food waste processing apparatus is very sanitary.

10 Claims, 9 Drawing Sheets

FOOD WASTE DISPOSAL APPARATUS WITH CENTRIFUGAL DEHYDRATOR

The present application claims priority under 35 U.S.C. §371 to PCT Application PCT/KR2010/003961, filed on Jun. 18, 2010, which claims priority to Korean Patent Application No. 10-2009-0060735, filed on Jul. 3, 2009, and to Korean Patent Application No. 10-2010-0044395, filed on May 12, 2010, the disclosures of which are hereby incorporated by reference in their entireties.

BACKGROUND OF THE INVENTION

1. Field of the Invention

The present invention relates to a food waste processing apparatus.

2. Description of the Prior Art

Minimizing moisture in food waste when it is discharged to reduce leachate has been a concern of many people.

To achieve this, various types of food waste processing apparatuses have been developed and used.

Since a conventional food waste processing apparatus includes a unit for dehydrating food waste, a unit for discharging food waste to the outside of a drum, and a unit for discarding the discharged food waste to the outside of the food waste processing apparatus.

Further, since food waste is broken up, dehydrated, and discharged by separate driving units such as a motor or a screw, manufacturing costs are further increased.

In addition, since food waste may be incompletely dehydrated and the dehydrated food waste may not be completely discharged and discarded frequently, the food waste processing apparatus is not sanitary.

SUMMARY OF THE INVENTION

Accordingly, the present invention has been made to solve the above-mentioned problems occurring in the prior art, and an aspect of the present invention provides a food waste processing apparatus which can reduce manufacturing costs.

Another aspect of the present invention provides a sanitary food waste processing apparatus which can completely dehydrate, discharge, and drain food waste.

In accordance with an aspect of the present invention, there is provided a food waste processing apparatus including: a motor having a rotary shaft; a housing through which the rotary shaft extends, the housing having a lower side installed in the motor, the housing having an introduction part formed at an upper surface thereof, through which food waste is introduced, the housing having a drainage hole and a discharge part formed at a lower surface thereof, wherein water extracted from the food waste is drained through the drainage hole and the food waste is discharged through the discharge part; and a drum having an upper drum part and a lower drum part, at least one of the upper drum part and the lower drum part being vertically movably installed so that the upper drum part and the lower drum part can come into contact with each other and be separated from each other to seal and open a space within the drum, the drum being installed within the housing to be rotatable about the rotary shaft and communicating with the introduction part, wherein the food waste is dehydrated when the upper drum part and the lower drum part accommodate the food waste introduced through the introduction part and rotate while sealing the food waste accommodated within the drum, and the dehydrated food waste is discharged into the housing by a centrifugal force and the food waste discharged into the housing is then discharged to the outside through the discharge part when the upper drum part and the lower drum part rotate while being spaced apart from each other.

In the food waste processing apparatus according to the embodiment of the present invention, food waste is discharged in the housing after the food waste is dehydrated by a centrifugal force within the rotating upper drum part and the lower drum part, and then the food waste is drained to the outside of the housing by the rotation of the lower drum part. That is, since food waste is dehydrated, discharged, and drained simply by upper drum part and the lower drum part, manufacturing costs can be reduced.

Furthermore, since the lower drum part is vertically moved by a relatively simple structure of a cam, a structure of the rotary shaft, and an inertial force, manufacturing costs can be reduced still further.

Food waste is dehydrated and discharged by a centrifugal force and the food waste within the housing is discharged to the outside of the housing by the discharge blade installed in the drum. That is, since food waste can be completely dehydrated, discharged, and drained, the food waste processing apparatus is very sanitary.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, a food waste processing apparatus according to an exemplary embodiment of the present invention will be described in detail with reference to the accompanying drawings.

Figure 1:
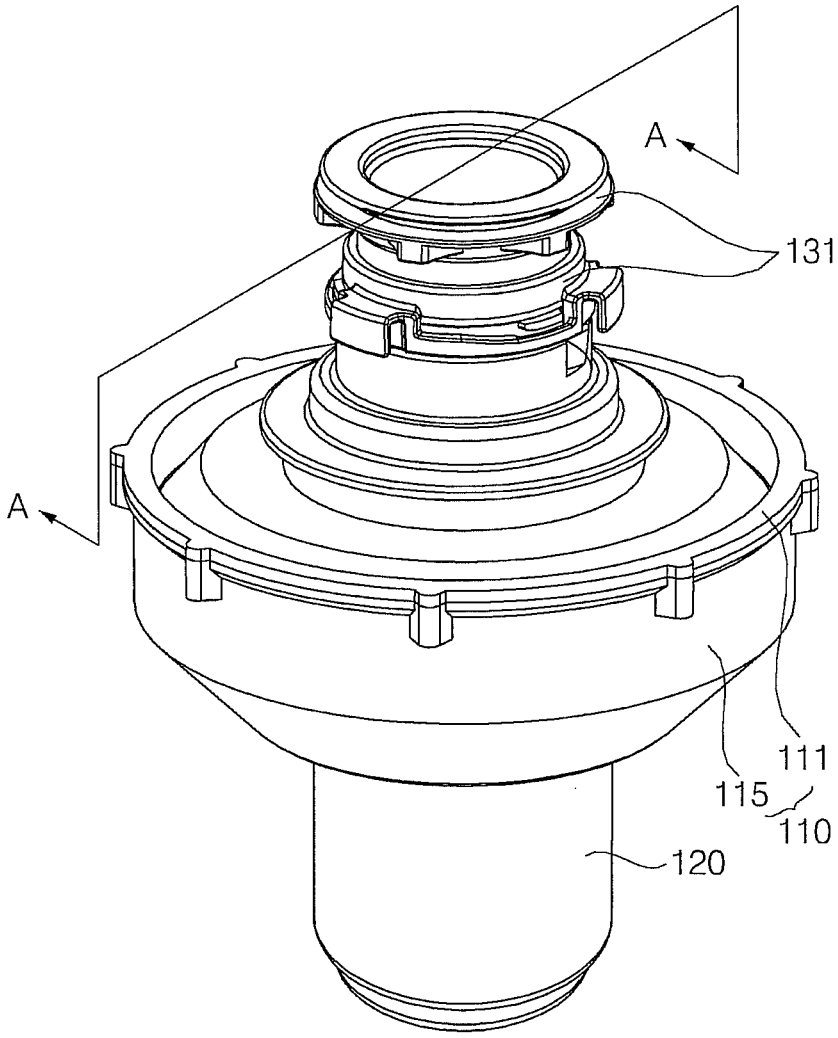
FIG. 1 is a perspective view of a food waste processing apparatus according to an embodiment of the present invention.
Figure 2:
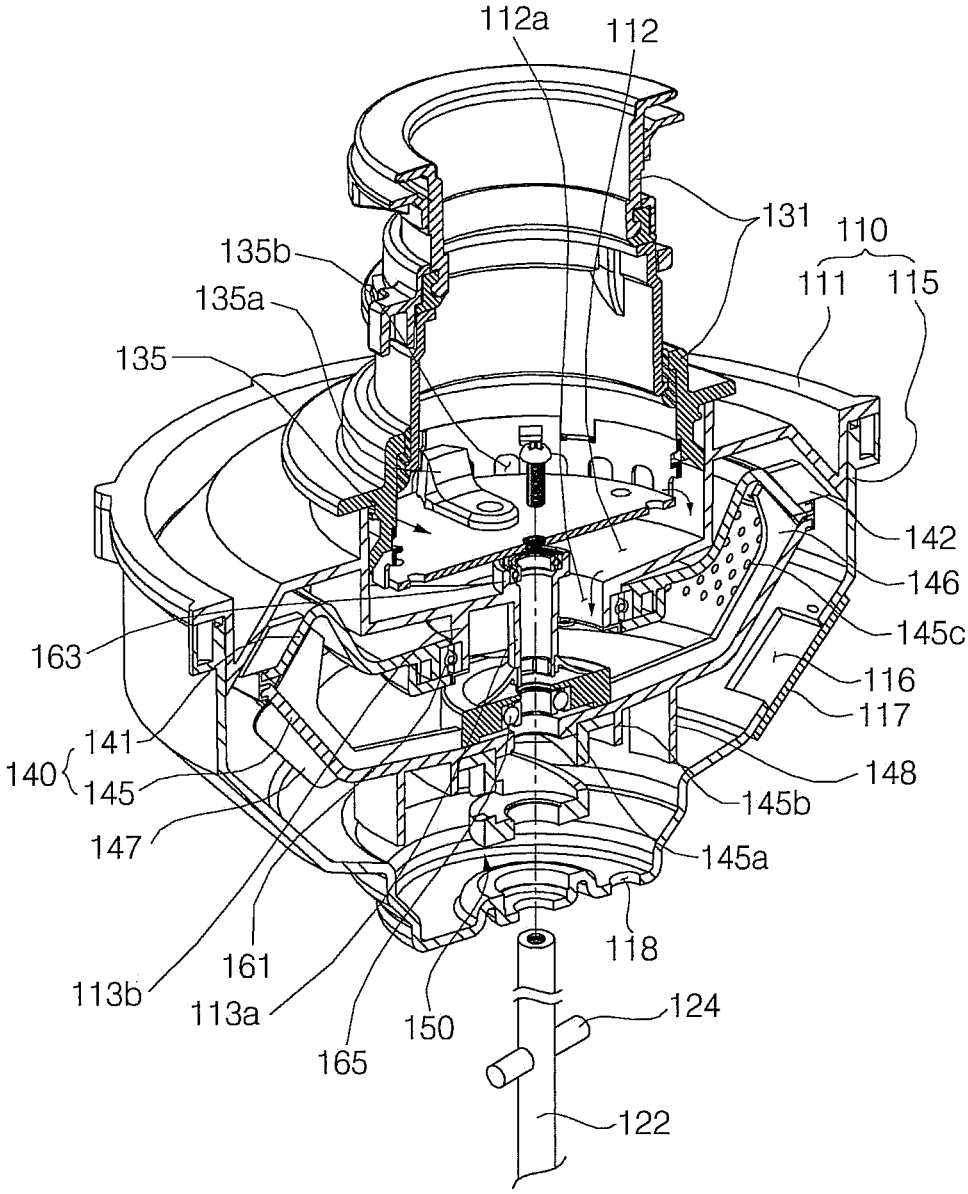
FIG. 2 is a partially sectional perspective view taken along line A-A wherein a motor of FIG. 1 is illustrated.

FIG. 1 is a perspective view of a food waste processing apparatus according to an embodiment of the present invention. FIG. 2 is a partially sectional perspective view taken along line A-A wherein a motor of FIG. 1 is illustrated.

As illustrated, the food waste processing apparatus according to the embodiment of the present invention includes a housing 110 having an upper housing 111 and a lower housing 115 coupled to each other Hereinafter, in indicating surfaces and directions of elements including the housing 110, a surface and a direction facing an upper side of the upper housing 111 corresponding to an upper surface of the housing 110 are referred to as "an upper surface and an upper side", and a surface and a direction facing a lower side of the lower housing 115 corresponding to a lower surface of the housing 110 are referred to as "a lower surface and a lower side"

A downwardly recessed recess 112 is formed at a central portion of the upper surface of the upper housing 111 corresponding to the upper surface of the housing 110 and a lower surface of the upper housing 111 is opened. An upper surface of the motor 120 having a rotary shaft 122 is coupled to a lower surface of the lower housing 115 corresponding to the lower surface of the housing 110 and an upper surface of the lower housing 115 is opened. Thus, a lower end surface of the upper housing 111 and an upper end surface of the lower housing 115 are coupled to each other to form an outer appearance of the food waste processing apparatus.

The upper end side of the rotary shaft 122 passes through the lower surface of the lower housing 115 and is located within the recess 112 of the upper housing 111.

A lower side of an introduction pipe 131 is inserted into and fixed to the recess 112, and an upper side of the introduction pipe 131 is coupled and fixed to a sink (not shown). A breaking unit 135 having a blade 135*a* for breaking up food waste is coupled to a lower end side of the introduction pipe 131. The breaking unit 135 is coupled to an upper end side of the rotary shaft 122 to be rotated during rotation of the rotary shaft 122.

After food waste is introduced from the upper side of the introduction pipe 131 and is broken up by the breaking unit 135, it is introduced into a below-described drum 140 through an introduction part 112*a* formed at an upper surface of the upper housing 111. A plurality of introduction holes 135*b* for feeding the broken up food waste to the introduction part 112*a* of the upper housing 111 is formed in the breaking unit 135.

The location of the introduction part 112*a* and the drum 140 will be described later.

A support pipe 113*a* extending downward and through which the rotary shaft 122 passes is formed at a central portion of the upper surface of the upper housing 111 defining the recess 112, and a ring-shaped coupling rim 113*b* is formed on the upper surface of the upper housing 111 outside the support pipe 113*a* to surround the support pipe 113*a*. The coupling rim 113*b* is formed at an upper surface of the upper housing 111 defining the recess 112, and the introduction part 112*a* is formed in the recess 112 between the coupling rim 113*b* and the support pipe 113*a*.

An inner peripheral surface of an upper drum part 141 of the drum 140 is rotatably coupled to an outer peripheral surface of the coupling rim 113*b*. A bearing 161 is interposed between an inner peripheral surface of the upper drum part 141 and an outer peripheral surface of the coupling rim 113*b* for smooth rotation of the upper drum part 141. A bearing 163 for supporting the smooth rotation of the rotary shaft 122 is installed at an upper portion of the support pipe 113*a*.

The drum 140 having an upper drum part 141 and a lower drum part 145 and communicated with the introduction part 112*a* to accommodate the food waste introduced into the introduction part 112*a* is installed within the housing 110.

At least one of the upper drum part 141 and the lower drum part 145 is vertically movably installed so that they are sealed or spaced apart while contacting or separating from each other, and is rotatably installed about the rotary shaft 122. Thus, if food waste is introduced between the upper drum part 141 and the lower drum part 145 through the introduction part 112*a*, the upper drum part 141 and the lower drum part 145 are rotated to dehydrate the food waste while being mutually sealed. If the upper drum part 141 and the lower drum part 145 are spaced apart from each other to be opened, the food waste dehydrated by the centrifugal forces of the upper drum part 141 and the lower drum part 145 which are rotating is discharged into the housing 110.

In the food waste processing apparatus according to the embodiment of the present invention, the lower drum part 145 is vertically moved.

In detail, the upper drum part 141 has a substantially reverse funnel-like shape, and an upper inner peripheral surface of the upper drum part 141 is rotatably coupled to an outer peripheral surface of the coupling rim 113*b* of the upper housing 111. Since the coupling rim 113*b* is coupled to an inner peripheral surface of the upper drum part 141, the introduction part 112*a* formed inside the coupling rim 113*b* is also located inside the inner peripheral surface of the upper drum part 141. Thus, since the introduction part 112*a* is communicated with an interior of the upper drum part 141, food waste is introduced into the drum 140 through the introduction part 112*a*.

The lower drum part 145 has a substantially funnel-like shape and is installed at the rotary shaft 122. The lower drum part 145 is vertically moved along the rotary shaft 122 by a below-described cam 150, and is rotated in conjunction with the cam 150.

If the cam 150 is raised, the lower drum part 145 is also raised, and the upper end surface of the lower drum part 145 contacts the lower end surface of the upper drum part 141 as the lower drum part 145 is raised. If the cam 150 is lowered, the lower drum part 145 is also lowered, and the upper end surface of the lower drum part 145 is spaced apart from the lower end surface of the upper drum part 141 as the lower drum part 145 is lowered.

When the food waste introduced between the upper drum part 141 and the lower drum part 145 is dehydrated, the upper drum part 141 and the lower drum part 145 contact each other to be sealed, and when the food waste introduced between the upper drum part 141 and the lower drum part 145 is discharged into the housing 110, the upper drum part 141 and the lower drum part 145 are spaced apart from each other to be opened.

The lower drum part 145 is rotated by the cam 150, and the upper drum part 141 is rotated by a frictional force with the lower drum part 145. Thus, after the food waste is dehydrated by a centrifugal force while the upper drum part 141 and the lower drum part 145 are rotated, it is discharged. The water dehydrated from the food waste due to rotation of the upper drum part 141 and the lower drum part 145 is discharged to the outside of the drum 140 through a dehydrating hole (not shown) formed in the upper drum part 141 and a dehydrating hole 145*a* formed in the lower drum part 145. The water discharged to the outside of the drum 140 is drained to the outside of the housing 110 through a drainage hole 118 formed at a lower surface of the housing 110.

The food waste in the drum 140 is moved along an inclined surface of the upper drum part 141 and an inclined surface of the lower drum part 145 and is discharged into the housing 110 through a space between the upper drum part 141 and the lower drum part 145 due to rotation of the drum 140. That is, the food waste is discharged between a periphery of the upper drum part 141 and a periphery of the lower drum part 145 to which the largest centrifugal force is applied.

A bearing 165 supported by the rotary shaft 1222 is installed within the lower drum part 145, and a plurality of inner blades 146 are installed in the bearing 165. The inner blades 146 are rotatably installed independently from the lower drum part 145. That is, the inner blades 146 are not rotated due to the rotation of the lower drum part 145 but are rotated due to the rotational inertia of the lower drum part 145.

The inner blades 146 contact an inclined surface of the lower drum part 145, and upper end portions of the inner blades 146 are bent at a border portion between the lower drum part 145 and the upper drum part 141 to contact an inclined surface of the upper drum part 141. Thus, since after food waste attached to the inclined surfaces of the upper drum part 141 and the lower drum part 145 is separated by the inner blades 146, it is discharged to the outside of the drum 140 into the housing 110 by a centrifugal force and then discharged to the outside of the housing 110, the food waste within the drum 140 is completely discharged to the outside of the housing 110.

A plurality of outer blades 142 nearly contacting an upper inner surface of the housing 110 are formed on an inclined upper surface of the upper drum part 141. The outer blades 142 prevent the food waste discharged between the upper drum part 141 and the lower drum part 145 while rotating in conjunction with the upper drum part 141 from being stuck to an upper inner surface of the housing 110.

The food waste discharged into the housing 110 is discharged to the outside of the housing 110 through a discharge part 116 formed in the lower housing 115. The discharge part 116 is located on a side higher than the discharge hole 118, and an opening/closing plate 117 for opening or closing the discharge part 116 is installed in the discharge part 116.

The opening/closing plate 117 may be installed in various fashions, such as a rotating manner, a sliding-door manner, or a hinged-door manner, to open or close the discharge part 116, and the food waste is discharged to the outside of the housing 110 through the opened discharge part 116.

A discharge blade 147 is installed at a lower surface of the lower drum part 145. The discharge blade 147 sweeps the food waste discharged into the housing 110 to move the food waste toward the discharge part 116 while rotating in conjunction with the lower drum part 145.

A blocking unit 148 for preventing the food waste discharged from the drum 140 into the housing 110 from being introduced into the discharge hole 118 of the housing 110 is formed at a lower surface of the lower drum part 145. The blocking unit 148 may be a ring-shaped rim or a plurality of bosses, so as to contact the lower surface of the housing 110, preventing the food waste from being introduced into the discharge hole 118 when the lower drum part 145 is lowered.

That is, the blocking unit 148 forms a circular fence while rotating in conjunction with the lower drum part 145, preventing the food waste discharged into the housing 110 from being separated from a rotation path of the discharge blade 147.

The cam 150 is vertically movably installed on an outer peripheral surface of the rotary shaft 122 between the lower housing 115 and the lower drum part 145. If the rotary shaft 122 is rotated, the cam 150 is raised due to its operation with the rotary shaft 122 and an inertial force, and if the rotary shaft 122 is stopped, the cam 150 is lowered due to a difference between its rotating speed and a rotating speed of the rotary shaft 122 and its operation with the rotary shaft 122. The cam 150 is rotated by the rotary shaft 122.

Figure 3:
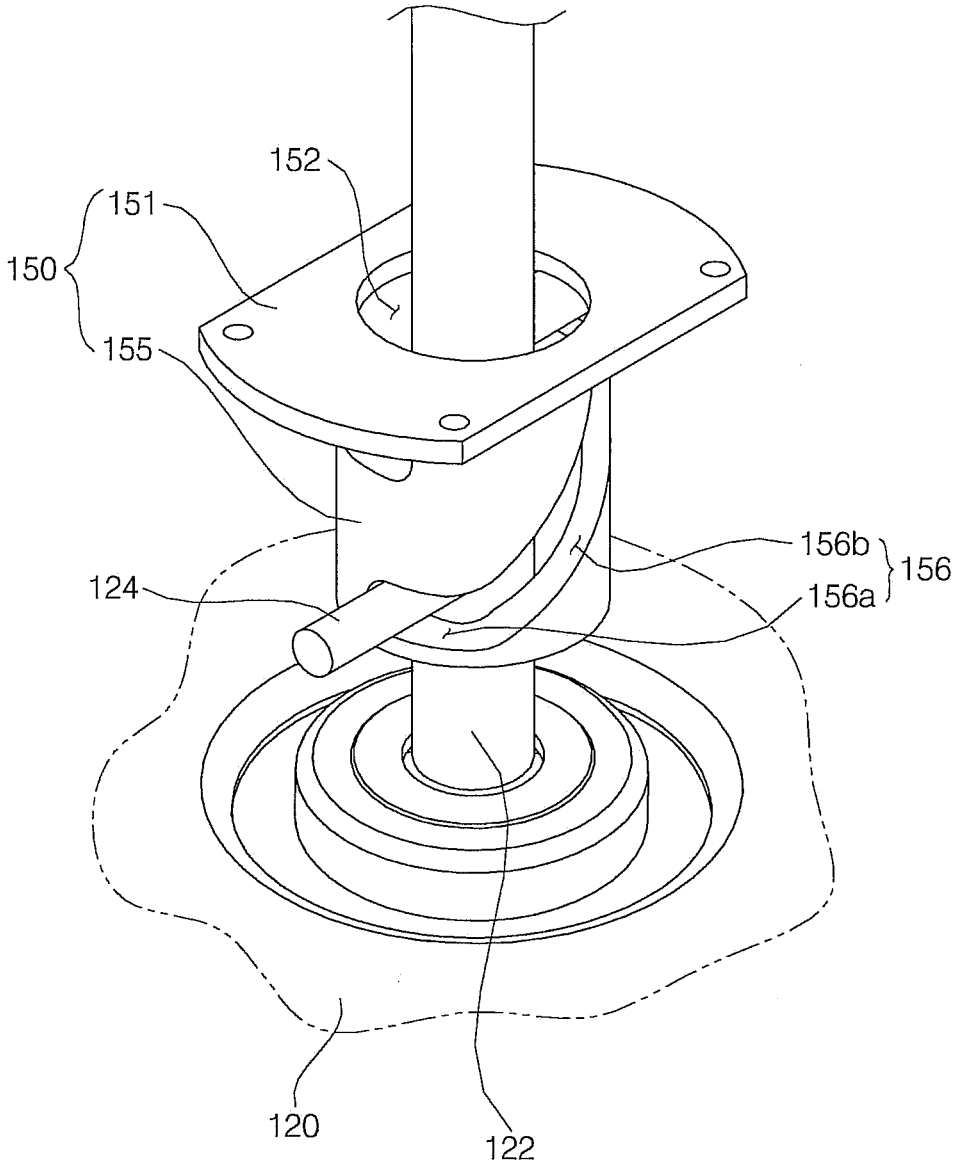
FIG. 3 is a perspective view illustrating a coupling of a rotary shaft of a motor to a cam of FIG. 2.
Figure 4:
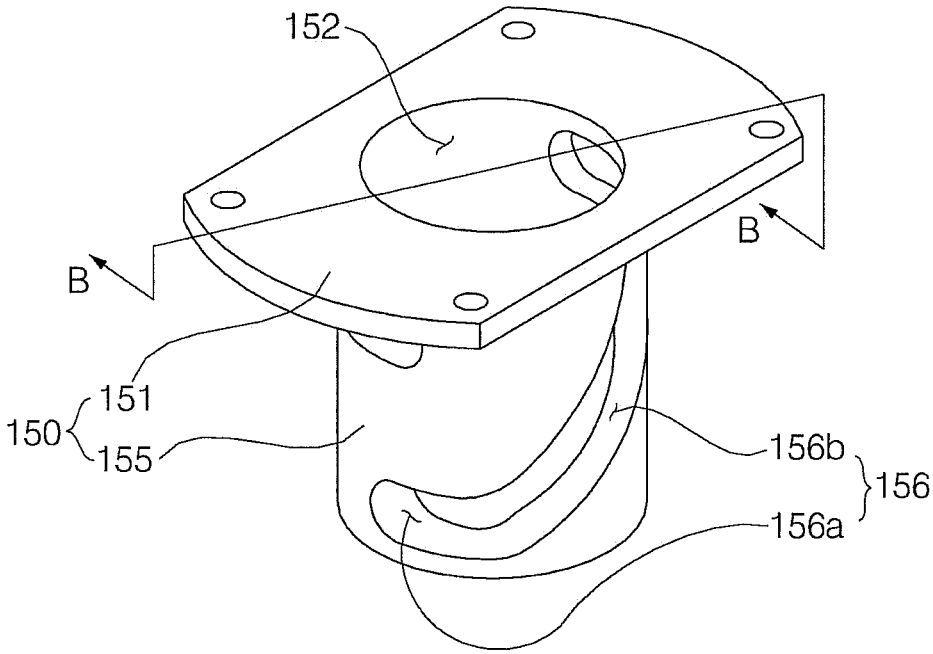
FIG. 4 is an exploded perspective view of the cam of FIG. 3.
Figure 5:
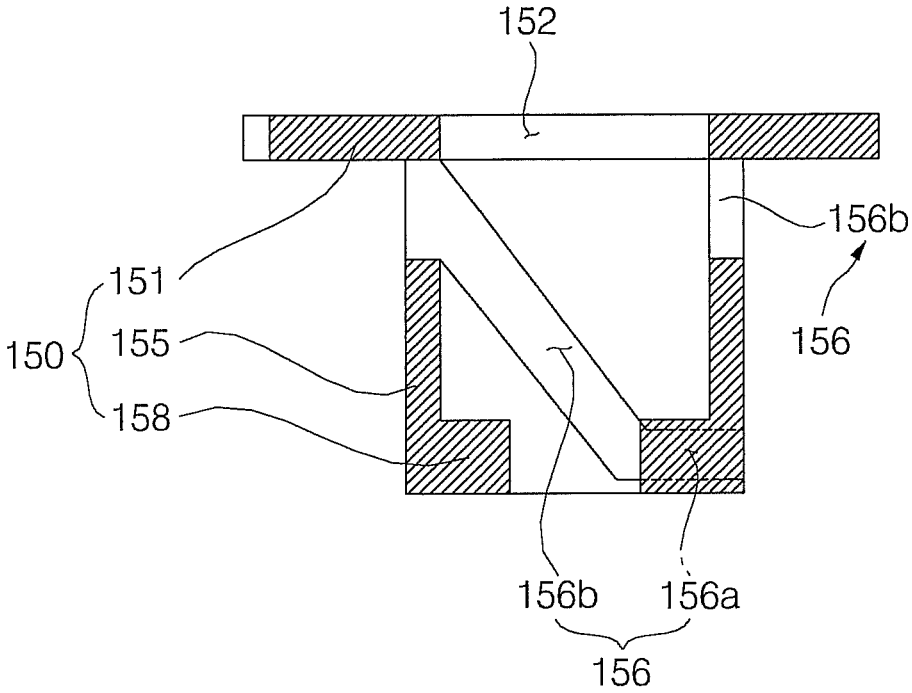
FIG. 5 is a sectional view taken along line B-B of FIG. 4.

The cam 150 will be described with reference to FIGS. 2 to 5. FIG. 3 is a perspective view illustrating a coupling of a rotary shaft of a motor to a cam of FIG. 2. FIG. 4 is an exploded perspective view of the cam of FIG. 3. FIG. 5 is a sectional view taken along line B-B of FIG. 4.

As illustrated, at least one support boss 124 is formed on an outer peripheral surface of a lower portion of the rotary shaft 122. Two or more support bosses 124 are formed at a regular interval along a circumferential direction of the rotary shaft 122 and each support boss 124 of two or more support bosses 124 is positioned at a same height of the rotary shaft 122 as the other support boss 124 as illustrated in FIG. 2.

The cam 150 has a coupling piece 151 having a through-hole 152 at a central portion thereof, a tube-shaped body 155 extending from an inner peripheral surface of the through-hole 152 and through which the rotary shaft 122 passes, and a plurality of reinforcing bosses 158 formed on an inner peripheral surface of a lower portion of the body 155 to reinforce the strength of the body 155.

The coupling piece 151 is coupled to a lower surface of the lower drum part 145. A ring-shaped inner support rim 145*a* and a ring-shaped inner support rim 145*b* are respectively formed on the lower surface of the lower drum part 145. The inner support rim 145*a* and the outer support rim 145*b* face each other with a predetermined interval and the outer support rim 145*b* surrounds the inner support rim 145*a*. After the coupling piece 151 is inserted and positioned between the inner support rim 145*a* and the outer support rim 145*b*, it is coupled to the lower drum part 145 by a coupling screw, etc. Thus, the lower drum part 145 is raised together with the cam 150 and is rotated together with the cam 150.

The body 155 is supported by and installed in the rotary shaft 122, and a guide passage 156 through which the support boss 124 passes is formed on an outer peripheral surface of the body 155. The guide passage 156 has a horizontal passage 156*a* and an inclined passage 156*b*.

The horizontal passage 156*a* is formed on an outer peripheral surface of a lower portion of the body 155 along a circumferential direction of the body and is formed horizontally with respect to the body 155. A lower end portion of the inclined passage 156*b* is communicated with a right end portion of the horizontal passage 156*a* and forms an obtuse angle with the horizontal passage 156*a*. The number of the guide passages 156 corresponds to the number of the support bosses 124.

Figure 6:
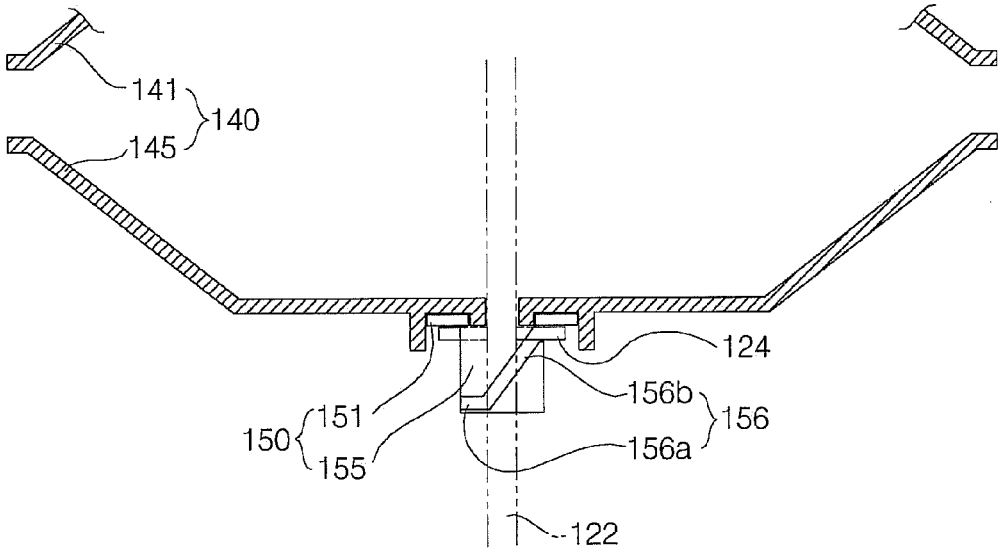
FIGS. 6 to 8 are partially sectional front views illustrating an operation of the cam and a lower drum part according to the embodiment of the present invention.
Figure 7:
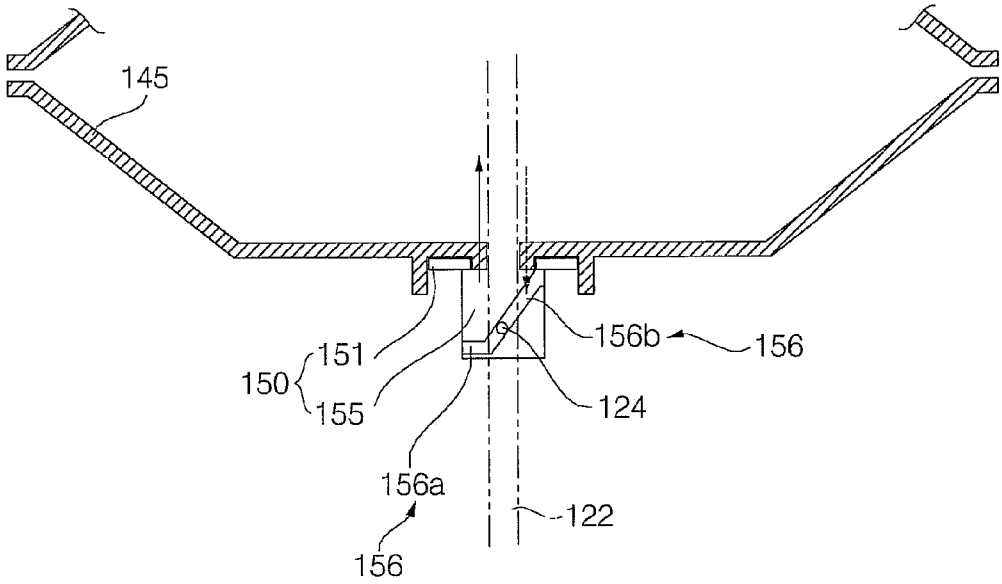
Figure 8:
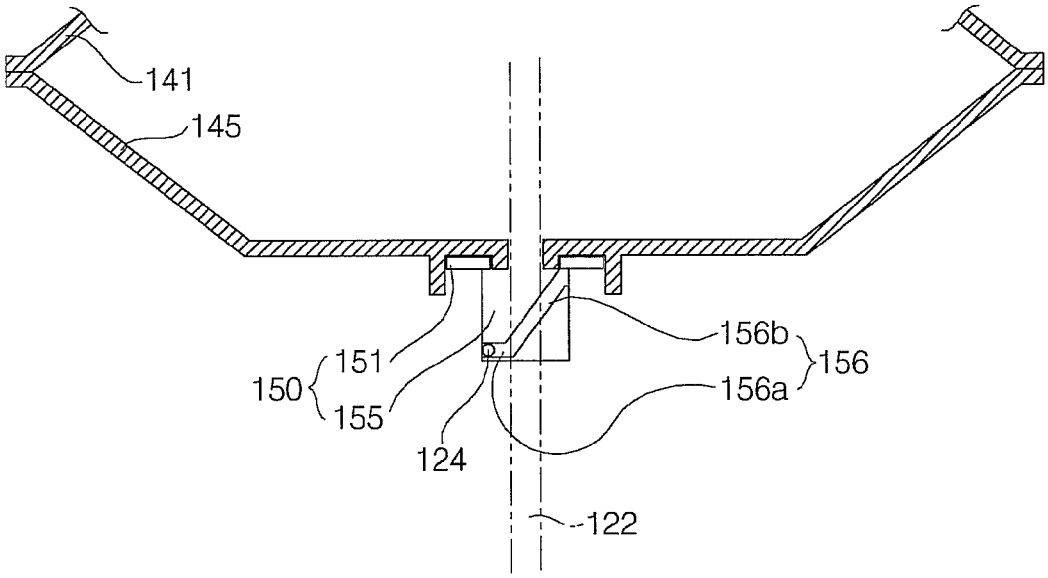

An operation of the cam 150 will be described with reference to FIGS. 6 to 8. FIGS. 6 to 8 are partially sectional front views illustrating an operation of the cam and a lower drum part according to the embodiment of the present invention.

As illustrated in FIG. 6, an initial state is assumed to be a state where the rotary shaft 122 is stopped, the lower drum part 145 is lowered by the weight of the lower drum part 145 to be spaced apart from the upper drum part 141. The initial state is a state where the upper drum part 141 and the lower drum part 145 are spaced apart from each other to be opened while the cam 150 is lowered and an upper end of the inclined passage 156*b* of the guide passage 156 is caught by the support boss 124.

In the initial state of FIG. 6, the motor 120 (see FIG. 3) is driven and the rotary shaft 122 is rotated. Then, since the rotary shaft 122 is rotated and the cam 150 and the drum 140 are stopped, as illustrated in FIG. 7, the support boss 124 is located at a middle portion of the inclined passage 156*b* of the guide passage 156. Consequently, the cam 150 raises the lowered drum 145 as it is raised in a direction of a solid arrow of FIG. 7.

If the rotary shaft 122 is further rotated from the state of FIG. 7, as illustrated in FIG. 8, the support boss 124 is moved to the horizontal passage 156*a* along the inclined passage 156*b* to be caught by a left end of the horizontal passage 156*a*. Then, the cam 150 is raised until the support boss 124 is located at a border portion between the inclined passage 156*b* and the horizontal passage 156*a*, and accordingly, the lower drum part 145 is raised to contact the upper drum part 141.

Thereafter, if the rotary shaft 122 is rotated while the support boss 124 is caught by the left end of the horizontal passage 156*a*, the cam 150 is rotated by the support boss 124, the lower drum part 145 is rotated by the cam 150, and the upper drum part 141 is rotated by a frictional force with the lower drum part 145.

Thereafter, if the motor 120 is stopped to gradually reduce a rotating speed of the rotary shaft 122 or a rotating speed of the rotary shaft 112, the drum 140 and the cam 150 are rotated at a speed higher than that of the rotary shaft 122 by an inertial force. Then, as illustrated in FIG. 7, due to a difference between a rotating speed of the cam 150 and a rotating speed of the rotary shaft 122, since the support boss 124 passes by a right end of the horizontal passage 156*a* of the cam 150 to be located in the inclined passage 156*b*, the cam 150 is lowered in a direction of a dotted arrow of FIG. 7.

If time further elapses, as illustrated in FIG. 6, since the support boss 124 is located at an upper end of the inclined passage 156*b*, the cam 150 is completely lowered to completely lower the lower drum part 145.

Figure 9:
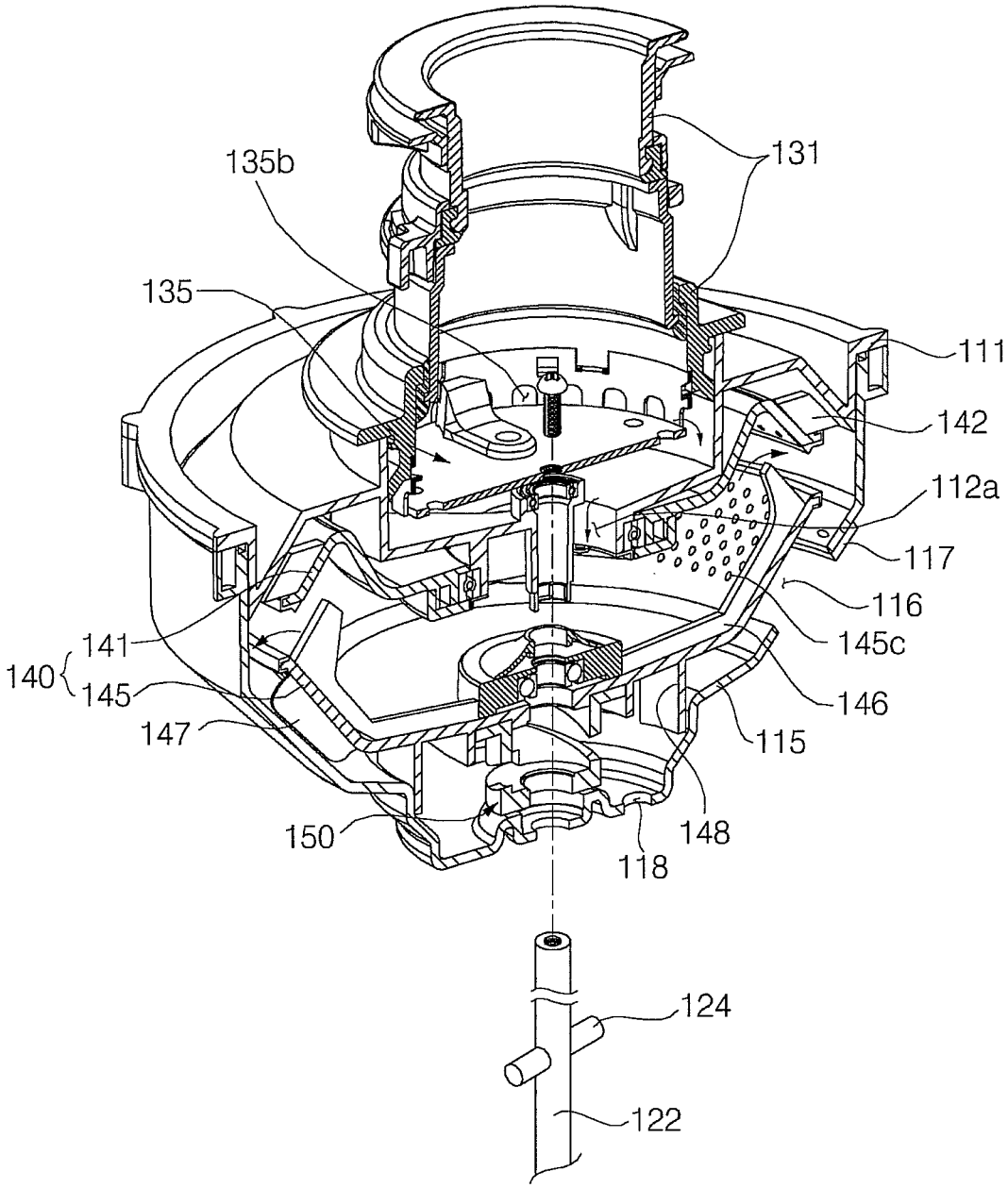
FIG. 9 is a view illustrating a state where the cam and the lower drum part of FIG. 2 are lowered.

An operation of the food waste processing apparatus of dehydrating, discharging, and draining food waste while the lower drum part 145 is vertically moved due to an operation of the cam 150 and the support boss 124 of the rotary shaft 122 according to the embodiment of the present invention will be described with reference to FIGS. 2, 3, and 9.

After food waste is introduced through the introduction pipe 131, the motor 120 is driven to rotate the rotary shaft 122. Then, the lower drum part 145 is raised while the cam 150 is raised by an operation of the above-described cam 150 and the rotary shaft 122 and an inertial force. If the lower drum part 145 is completely raised by the cam 150, as illustrated in FIG. 2, the lower drum part 145 contacts the upper drum part 141 so that they are sealed.

After the cam 150 and the lower drum part 145 are completely raised, they are rotated by the rotary shaft 122 and the breaking unit 135 is rotated by the rotary shaft 122 before the cam 150 and the lower drum part 145 are rotated, breaking up food waste. The rotation of the cam 150 and the lower drum part 145 and the rotation of the breaking unit 135 have a minute time gap.

The food waste broken up by the shattering unit 135 is introduced into the drum 140 through the introduction hole 135*b* and the introduction part 112*a*. The food waste introduced into the drum 140 is first rotated by the drum 140 to be dehydrated, and the dehydrated water is discharged through the discharge hole of the upper drum part 141 and the discharge hole 145*c* of the lower drum part 145 and is drained through the drainage hole 118 of the housing 110.

After the food waste is completely dehydrated, if the motor 120 is stopped to gradually reduce a rotating speed of the rotary shaft 122, or a rotating speed of the rotary shaft 122, the drum 140 and the cam 150 are rotated at a speed higher than that of the rotary shaft 122 due to an inertial force.

Then, the cam 150 is lowered by an inertial force and an operation of the above-described cam 150 and the rotary shaft 122. If the lower drum part 145 is lowered, as illustrated in FIG. 9, since the lower drum part 145 is spaced apart from the upper drum part 141, the food waste dehydrated between the lower drum part 145 and the upper drum part 141 is discharged into the housing 110 by a centrifugal force of the rotating drum 140.

The food waste discharged between the upper drum part 141 and the lower drum part 145 is not stuck to an upper inner surface of the housing 110 due to the outer blade 147 and is discharged to a lower side of an interior of the housing 110. In the case where food waste is stuck to the upper drum part 141 and the lower drum part 145, after being separated by a discharge blade 147 rotating independently from the lower drum part 145, it is discharged into the housing 110 by a centrifugal force.

The blocking unit 148 formed on a lower surface of the lower drum part 145 contacts the lower housing 115 to block food waste from moving toward the drainage hole 118 and the opening/closing plate 117 formed in the lower housing 115 opens the discharge part 116. The food waste discharged into the housing 110 is swept by a discharge blade 147 coupled to a lower surface of the lower drum part 145 to be rotated in conjunction with the lower drum part 145 to be moved toward the discharge part 116, and is discharged to the outside of the housing 110.

When food waste is to be discharged to the outside of the drum 140 and be discharged to the outside of the housing 110, a rotating speed of the rotary shaft 122 is repeatedly reduced and then accelerated.

In the food waste processing apparatus according to the embodiment of the present invention, after food waste is dehydrated by a centrifugal force within the upper drum part 141 and the lower drum part 145 which are rotated to be discharged, it is discharged to the outside of the housing 110 by the rotation of the lower drum part 145. That is, since food waste is dehydrated, discharged, and drained by one part, manufacturing costs can be reduced.

Further, since food waste is broken up, dehydrated, discharged, and drained by one motor 120, manufacturing costs can be reduced further.

Furthermore, since the lower drum part 145 is vertically moved by a relatively simple structure of the cam 150, a structure of the rotary shaft 122, and an inertial force, manufacturing costs can be reduced still further.

Food waste is dehydrated and discharged by a centrifugal force and the food waste within the housing 110 is discharged to the outside of the housing 110 by the discharge blade 147 installed in the drum 140. That is, since food waste can be completely dehydrated, discharged, and drained, the food waste processing apparatus is very sanitary.

Although the present invention has been described with reference to the limited example and drawings, the present invention is not limited thereto and those skilled in the art will appreciate that various modifications, additions and substitutions are possible, without departing from the scope and spirit of the invention as disclosed in the accompanying claims.

What is claimed is:

1. A food waste processing apparatus comprising:

a motor having a rotary shaft;

a housing through which the rotary shaft extends, the housing having a lower side installed in the motor, the housing having an introduction part formed at an upper surface thereof, through which food waste is introduced, the housing having a drainage hole and a discharge part formed at a lower surface thereof, wherein water extracted from the food waste is drained through the drainage hole and the food waste is discharged through the discharge part; and a drum having an upper drum part and a lower drum part, at least one of the upper drum part and the lower drum part being vertically movably installed so that the upper drum part and the lower drum part can come into contact with each other and be separate from each other to seal and open a space within the drum, the drum being installed within the housing to be rotatable about the rotary shaft and communicating with the introduction part, wherein the food waste is dehydrated when the upper drum part and the lower drum part accommodate the food waste introduced through the introduction part and rotate while sealing the food waste accommodated within the drum, and the dehydrated food waste is then discharged from the drum into the housing by a centrifugal force, and the food waste that was discharged into the housing is subsequently discharged to the outside of the housing through the discharge part when the upper drum part and the lower drum part rotate while being spaced apart from each other.

2. The food waste processing apparatus as claimed in claim 1, wherein the drum has the upper drum part having a reverse funnel-like shape and having a dehydrating hole through which water dehydrated from the food waste is discharged and the lower drum part having a funnel-like shape and having a dehydrating hole through which the water dehydrated from the food waste is discharged, and the food waste is moved along an inclined surface of the upper drum part and an inclined surface of the lower drum part and is discharged between a peripheral portion of the upper drum part and a peripheral portion of the lower drum part to which the largest centrifugal force is applied.

3. The food waste processing apparatus as claimed in claim 1, wherein an inner blade rotates by a rotating inertial force of the lower drum part to drop the food waste attached to the upper drum part and the lower drum part, and wherein the inner blade is rotatably installed within the lower drum part independently from the lower drum part.

4. The food waste processing apparatus as claimed in claim 1, wherein a cam is vertically movably installed on an outer peripheral surface of the rotary shaft located within the housing and is also rotated by the rotary shaft, configured to rotate and also raise one of the upper drum part and the lower drum part while itself being raised by an operation of the rotary shaft and an initial force if the rotary shaft is rotated, and configured to lower the one of the upper drum part and the lower drum part while itself being lowered by a difference between its rotating speed and a rotating speed of the rotary shaft and its operation with the rotary shaft.

5. The food waste processing apparatus as claimed in claim 4, wherein a guide passage having a horizontal passage horizontally formed with respect to a body of the cam along a circumferential direction of the cam and an inclined passage communicated with one end of the horizontal passage and forming an obtuse angle with the horizontal passage is formed in the cam and a support boss for supporting a motion of the cam and passing through the guide passage is formed in the rotary shaft.

6. The food waste processing apparatus as claimed in claim 5, wherein an upper side of the upper drum part is supported and rotatably installed inside the housing and communicates with the introduction part and a lower side of the lower drum part is engaged with the cam to be moved together with the cam, wherein if the cam is raised, the lower drum part is raised and an upper side of the lower drum part contacts a lower side of the upper drum part so as to rotate the upper drum part with frictional force to dehydrate the food waste, and if the cam is lowered, the lower drum part is lowered and the upper side of the lower drum part is spaced apart from the lower side of the upper drum part to open the upper drum part so that the dehydrated food waste is discharged from the upper and the lower drum parts into the housing by centrifugal force and subsequently, the food waste is further discharged from the housing to the outside through the discharge part.

7. The food waste processing apparatus as claimed in claim 6, wherein a plurality of outer blades are formed on an inclined upper surface and also rotate in conjunction with the upper drum part for preventing the food waste discharged between the upper drum part and the lower drum part from being stuck to the upper inner surface of the housing, an opening/closing plate is installed in the discharge part for opening and closing the discharge part, a discharge blade is installed on a lower surface of the lower drum part for feeding the food waste discharged into the housing toward the discharge part while being rotated in conjunction with the lower drum part, and a blocking unit is formed on a lower surface of the lower drum part for preventing the food waste discharged into the housing from being moved toward the drainage hole while contacting the housing when the lower drum part is lowered.

8. The food waste processing apparatus as claimed in claim 5, wherein two pairs of the guide passages and the support bosses correspond to each other respectively, the cam has a coupling piece coupled to the lower drum part and having a through-hole through which the rotary shaft passes at a central portion thereof and a tube-shaped body extending from an inner peripheral surface of the through-hole to a lower side, through which the rotary shaft passes, and having the guide passages, and a ring-shaped inner support rim and a ring-shaped outer support rim for defining a space into which the coupling piece is inserted and coupled are formed on a lower surface of the lower drum part, and wherein the ring-shaped inner support rim and the ring-shaped outer support rim are spaced apart from each other within a predetermined distance.

9. The food waste processing apparatus as claimed in claim 1, wherein the housing has an upper housing and a lower housing coupled to each other, a downwardly recessed recess is formed on an upper surface of the upper housing, a support pipe extending downward and through which the rotary shaft passes and a ring-shaped coupling rim disposed to surround the support pipe and to which an inner peripheral surface of the upper drum part is rotatably coupled are formed on an upper surface of the upper housing defining the recess, and the introduction part is formed in the recess between the support pipe and the coupling rim.

10. The food waste processing apparatus as claimed in claim 1, wherein a breaking unit for breaking up the food waste while being rotated by the rotary shaft of the motor is installed at a portion of the housing where the introduction part is formed to be communicated with the introduction part.

* * * * *